US011433416B2

(12) United States Patent
Perego

(10) Patent No.: US 11,433,416 B2
(45) Date of Patent: Sep. 6, 2022

(54) APPARATUS FOR PAINTING ARTICLES

(71) Applicant: TAPEMATIC S.P.A., Ornago (IT)

(72) Inventor: Luciano Perego, Ornago (IT)

(73) Assignee: TAPEMATIC S.P.A., Ornago (IT)

( * ) Notice: Subject to any disclaimer, the term of this patent is extended or adjusted under 35 U.S.C. 154(b) by 513 days.

(21) Appl. No.: 16/527,176

(22) Filed: Jul. 31, 2019

(65) Prior Publication Data

US 2020/0038899 A1 Feb. 6, 2020

(30) Foreign Application Priority Data

Jul. 31, 2018 (IT) ..... 102018000007709

(51) Int. Cl.

| | |
|---|---|
| ***B05B 16/00*** | (2018.01) |
| ***B05B 12/00*** | (2018.01) |
| ***B05B 13/04*** | (2006.01) |
| ***B05B 13/02*** | (2006.01) |
| ***B05B 16/20*** | (2018.01) |
| ***B05B 16/40*** | (2018.01) |
| ***B05B 14/40*** | (2018.01) |

(52) U.S. Cl.

CPC ..... *B05B 16/90* (2018.02); *B05B 12/002* (2013.01); *B05B 13/0235* (2013.01); *B05B 13/0442* (2013.01); *B05B 13/0447* (2013.01); *B05B 16/20* (2018.02); *B05B 16/40* (2018.02); *B05B 14/40* (2018.02)

(58) Field of Classification Search

CPC . B05B 16/00–95; B05B 12/002; B05B 13/02; B05B 13/0278; B05B 13/04; B05B 13/0405

See application file for complete search history.

(56) References Cited

U.S. PATENT DOCUMENTS 4,173,198 A 11/1979 Allen
4,458,626 A 7/1984 Dessilani
(Continued)

FOREIGN PATENT DOCUMENTS

EP 0041482 A1 12/1981

OTHER PUBLICATIONS

Extended European Search Report for Application EP 19182300.4 dated Dec. 18, 2019 (10 pages).

*Primary Examiner* — Dah-Wei D. Yuan
*Assistant Examiner* — Stephen A Kitt
(74) *Attorney, Agent, or Firm* — Brandon V. Zuniga; James R. Gourley; Carstens & Cahoon, LLP

(57) ABSTRACT

An apparatus for painting articles comprises a painting booth delimited by side walls and having at least one inlet opening and an outlet opening reciprocally aligned on two of said respectively opposite side walls. A transport assembly moves a plurality of articles being processed respectively aligned along a movement path extending through the painting booth, to lead the articles being processed therein through the inlet opening and to extract said articles through the outlet opening. The delivery nozzles operatively arranged inside the painting booth deliver atomised paint against the articles transported along the movement path. Adjustment devices comprising adjustment knobs positioned externally of the painting booth and manually accessible by an operator operate on each delivery nozzle to modify its positioning with respect to the articles being processed.

11 Claims, 4 Drawing Sheets

(56) References Cited

U.S. PATENT DOCUMENTS

| | | | | |
|---|---|---|---|---|
| 4,541,565 | A | 9/1985 | Deimerly | |
| 4,762,013 | A * | 8/1988 | Peter | B05B 13/041 118/315 |
| 5,482,556 | A | 1/1996 | Shutic et al. | |
| 2004/0065752 | A1 * | 4/2004 | Mather | B05B 13/0405 239/261 |
| 2007/0169691 | A1 * | 7/2007 | Rodrigues | B05B 13/0457 118/309 |
| 2009/0155449 | A1 | 6/2009 | Plans | |
| 2009/0304930 | A1 | 12/2009 | Chaimberg | |

* cited by examiner

APPARATUS FOR PAINTING ARTICLES

CROSS-REFERENCE TO RELATED APPLICATIONS

This application claims the benefit under 35 U.S.C. § 119(a) and 37 CFR § 1.55 to Italian patent application 102018000007709 filed Jul. 31, 2018, the entire content of which is incorporated herein by reference.

FIELD OF THE INVENTION

The present invention relates to an apparatus for painting articles. Particularly, in a preferential embodiment, the invention can be conveniently used for the execution of painting processes on articles of small dimensions such as, e.g., containers, bottles, closure elements, keys, knobs or similar objects.

BACKGROUND OF THE INVENTION

Currently, the use of containers, bottles, closure elements, keys, knobs or other objects having a high degree of surface finishing is in great demand, e.g., in the pharmaceutical field, in cosmetics, in machine components industry etc.

The degree of finishing required may require different surface treatments, depending on the type of finishing desired. For example, when a painting process is adopted it is normally required that each article being processed, generally of plastic material, is initially subjected to preparation by means of cleaning, possible activation by means of the corona effect, application of a primer and/or base coating, deposition of a pigmented layer, and deposition of a transparent protective finishing (top coating). The applications of the base layer, of the pigmented coating and of the protective finishing are each followed by a drying treatment, for example by infrared and/or UV irradiation.

U.S. Pat. No. 9,487,857, on behalf of the same Applicant, describes a machine for painting articles, each arranged on a piece-holding spindle. The piece-holding spindles are grouped together on respective trays that advance along a supply line. Adjacent to the supply line is a rotating platform provided with a plurality of seats distributed circumferentially around its own rotation axis. Transfer members lend themselves to withdrawing each piece-holding spindle from the respective tray arranged along a supply line, to place it in one of the seats and vice versa. Due to the rotation of the platform, the articles carried by the piece-holding spindles transit sequentially through various work stations, including a painting station at which one or more painting nozzles are installed which are designed to deliver paint against the articles which passes in front thereof. In the painting station are also installed actuation means operating on the piece-holding spindle to determine the rotation of the article to be painted around the axis thereof.

The Applicant believes that the current painting apparatuses can be improved in terms of operating flexibility and setting simplicity for the purposes of execution of different processing operations from time to time. In particular, it has been observed that at the current state of the art it is difficult to find a proper compromise between multiple process variables which contribute to the correct execution of the painting or similar surface finishing treatment, especially where the production needs require a frequent replacement of the type of the articles being processed.

The Applicant has in fact observed that in order to meet the needs of the market, tending to a progressive increase in the quality standards of the final product, it is important that the painting is carried out according to specific parameters which may vary from time to time depending on different factors that are not always easily predictable and/or controllable, such as, e.g., the materials with which the articles being processed are made, their geometric and dimensional characteristics, the physical surface characteristics, the paints used, the environmental conditions in which the process takes place.

Moreover, especially where frequent replacement of the type of articles being processed is required, the process specifications required by each processing can be different from those required for another processing.

A greater efficiency in painting is also increasingly required, in particular through a reduction in the amount of paint dispersed in the painting environment. In fact, the high dispersion found in the known art leads to increasing economic losses due both to the cost of the wasted paint and to the additional costs for its disposal, the replacement of the filters, the cleaning and maintenance of the machinery, as well as environmental impact issues.

In this regard the Applicant has observed that in the painting or similar treatments provided in the finishing cycle, one of the critical parameters that significantly affect a good execution of the processing is represented by the delivery position and direction of the atomised paint jets from the delivery nozzles. Particularly, for the purpose of carrying out the painting it is advisable that the deliveries maintain a suitable orientation to direct the maximum quantity of paint, favouring a homogeneous distribution on the surfaces of the articles being processed. It may be required that the suitable orientation for the optimal execution of the processing is different from time to time, also depending on the dimensions and geometric characteristics of the articles being processed. Moreover, it is convenient that the articles translate in front of the paint delivery nozzles at a speed and for a controlled time, which may be different from time to time depending on the type of processing. The delivery position and direction of the paint must also be adapted to the variation of the speeds with which, depending on the type of processing required, the transfer and/or rotation of the articles passing in the painting booth are implemented.

All these process variables require frequent adjustments of the position and orientation of the paint delivery nozzles. Currently the execution of these adjustments normally requires the stopping of the entire processing line to enable an operator to carry out the required interventions, and the restart of the line in order to observe the result of the intervention carried out. At least in the cases in which the painting takes place inside a controlled atmosphere booth, the restart phase takes some time to stabilize the atmospheric conditions in the booth, with production losses or possible production waste for the articles possibly treated when the conditions are not yet fully restored.

SUMMARY OF THE INVENTION

The main object of the present invention is to overcome the limitations of the state of the art, increasing the efficiency and the operational versatility in painting or similar surface treatment of articles, and simplifying the setting of the process for the purpose of an optimal execution of the processing. In particular, we want to offer an apparatus wherein painting can be carried out more efficiently, in any operating condition.

More specifically, an apparatus which makes it possible to easily modulate the distribution of the atomised paint in the environment wherein the operation takes place is proposed, to favour an optimal and easily adaptable distribution, if necessary also in real time, to the specific production needs.

It is also intended to provide a technical solution suitable to reduce the dimensions and the internal volumes of the painting booths, both to the advantage of reducing the overall dimensions and the manufacturing costs, and to the advantage of a simplification of cleaning operations possibly required for maintenance purposes or during the changing of the colour etc.

According to the present invention, a greater efficiency in painting is made possible thanks to a greater adaptability of the apparatus to the various process conditions, providing the possibility of adjusting the position and/or orientation of each of the paint delivery nozzles inside a painting booth, by means of simple adjustments that do not necessarily require an interruption of the processing.

More particularly, the invention relates to an apparatus for painting articles, comprising: a painting booth delimited by side walls; a transport assembly configured to move a plurality of articles being processed respectively aligned along a movement path extending through the painting booth, to lead the articles being processed inside the painting booth itself; at least one delivery nozzle operatively arranged inside the painting booth to deliver atomised paint against the articles transported along the movement path; adjustment devices operating on said dispensing nozzle to modify its positioning with respect to the articles being processed. The adjustment devices include: at least one first adjustment knob positioned outside the painting booth and manually accessible to an operator; at least one support rod carrying the delivery nozzle and extending through one of the side walls of the painting booth; transmission members operatively connected with the support rod and with the adjustment knob, to modify the positioning of the nozzle upon a drive action on the knob itself.

The possibility of intervention on the adjustment devices from the outside of the painting booth is thus achieved, and it is therefore possible to modify the position and/or orientation of the delivery nozzles observing the result obtained directly during processing, without having to stop the production line.

The adjustment from the outside of the painting booth also allows the adoption of more compact painting booths, eliminating the volumes required in the known art to house the adjustment systems and the spaces necessary to allow the operator to access them.

Preferred embodiments of the invention may conveniently comprise one or more of the following preferred features.

Preferably, the transmission members are positioned externally to the painting booth.

Preferably, the transmission members engage one end of the support rod protruding externally from the painting booth.

Preferably, the support rod extends substantially parallel to the movement path.

Preferably, the movement path extends through at least one opening arranged in at least one of the side walls of the painting booth.

Preferably, the support rod extends through the side wall of the painting booth carrying said at least one opening.

Preferably, the movement path extending through the painting booth, to lead the articles being processed inside the painting booth itself through an inlet opening, and to extract said articles through an outlet opening present in the painting booth.

Preferably, the inlet opening and the outlet opening are mutually aligned on two of said respectively opposite side walls.

Preferably, the transmission members comprise a first linear guide extending along a first adjustment axis.

Preferably, the transmission members comprise a first slider slidably engaged along the first linear guide and carrying said support rod.

Preferably, the transmission members comprise a first block carried by the first linear guide and rotatably engaging the first adjustment knob.

Preferably, the transmission members comprise a first threaded bar integral with the first adjustment knob and operatively engaged through the first slider and the first block.

Preferably, the first threaded bar rotatably crosses the first block and engages by screwing the first slider.

Preferably, the first linear guide is integral with respect to the painting booth.

Preferably, the adjustment devices comprise also at least a second adjustment knob positioned outside the painting booth and manually accessible to an operator.

Preferably, the adjustment devices comprise a second linear guide carried by the first slider.

Preferably, the second linear guide extends along a second adjustment axis transverse to the first adjustment axis.

Preferably, the adjustment devices comprise a second slider slidably engaged along the second linear guide and carrying said support rod.

Preferably, the adjustment devices comprise a second block carried by the second linear guide and rotatably engaging the second adjustment knob.

Preferably, the adjustment devices comprise a second threaded bar integral with the second adjustment knob and operatively engaged through the second slider and the second block.

Preferably, the second threaded bar rotatably crosses the second block and engages by screwing the second slider.

Preferably, the second adjustment axis is orthogonal with respect to the first adjustment axis.

Preferably, the second adjustment axis is orthogonal with respect to a movement path of the articles through the painting booth.

Preferably, the adjustment devices further comprise a rotation joint.

Preferably, the rotation joint is positioned externally to the painting booth.

Preferably, the rotation joint comprises a fixed portion rigidly carried by the second slider.

Preferably, the rotation joint comprises a movable portion rotatably engaged to the fixed portion around a third adjustment axis.

Preferably, the third adjustment axis is substantially coaxial to a longitudinal axis of the support rod.

Preferably, the rotation joint comprises locking devices of the movable portion with respect to the fixed portion.

Preferably, the locking devices can be selectively deactivatable to allow a rotation of the nozzle around the third adjustment axis.

A plurality of delivery nozzles, each provided with respective adjustment devices, is preferably provided.

Preferably, the first linear guide slidably engages two or more first sliders, each being part of the adjustment devices of one of said delivery nozzles.

Preferably, a first and a second series of delivery nozzles are provided, each carried by a respective support rod.

Preferably, the support rods carrying the delivery nozzles belonging to the first and second series extend through respective side walls of the painting booth.

Preferably, the support rods carrying the delivery nozzles belonging to the second series extend through one of the side walls of the painting booth opposite to the side wall crossed by the support rods carrying the delivery nozzle belonging to the first series.

BRIEF DESCRIPTION OF THE DRAWINGS

Further characteristics and advantages will become more apparent from the detailed description of a preferred, yet not limiting, embodiment of a apparatus for the of articles, according to the present invention. Such description will be set forth hereinafter with reference to the accompanying drawings given only for illustrative and, therefore, non-limiting purpose, wherein.

DETAILED DESCRIPTION

Figure 1:
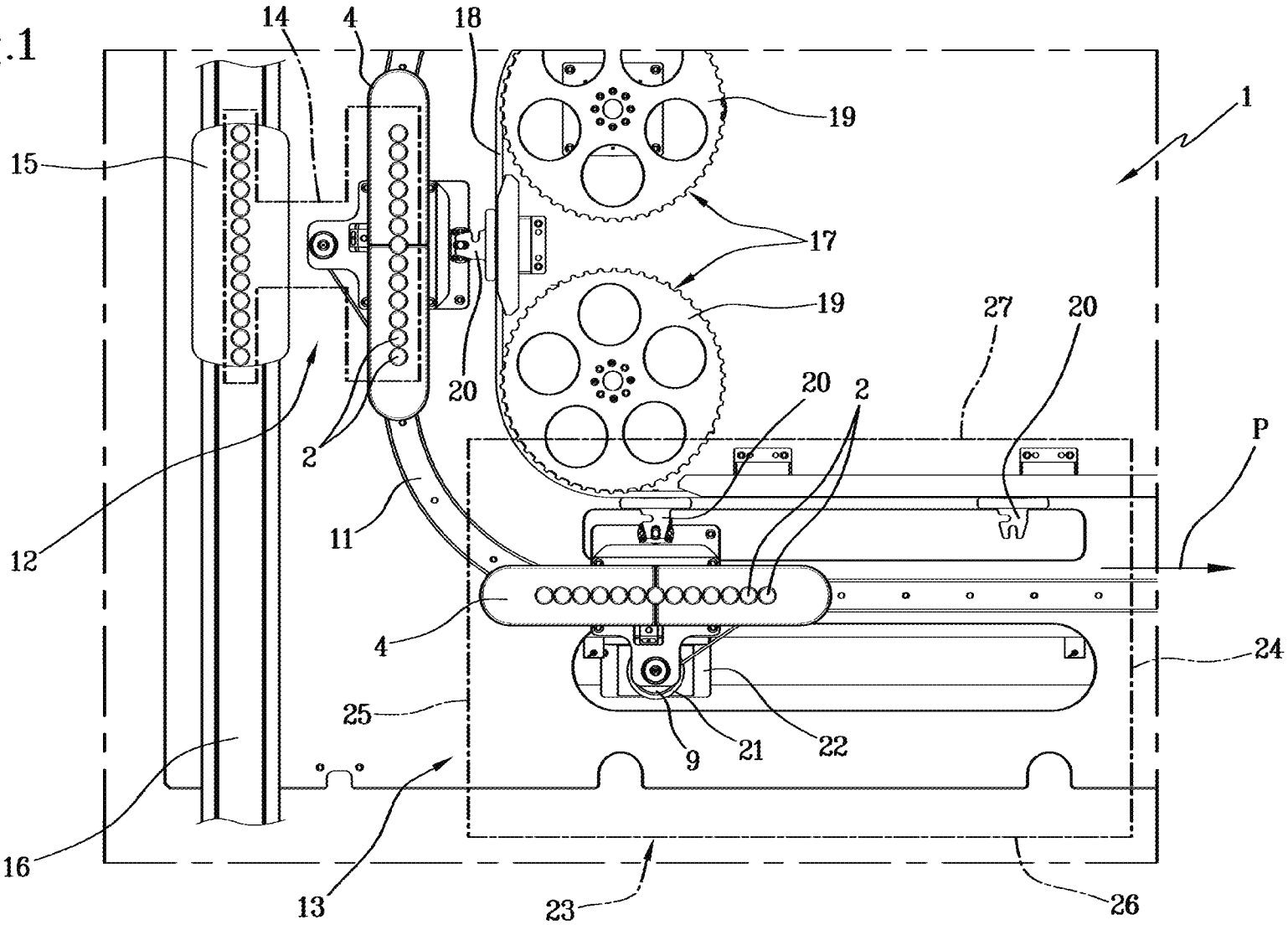
FIG. 1 represents a partially interrupted schematic plan view showing an apparatus according to the present invention, installed in a painting line.

With reference to the mentioned figures, number 1 generally indicates an apparatus for painting articles, according to the present invention.

In the illustrated embodiment, the apparatus 1 is arranged for the execution of a painting treatment of a plurality of articles 2, each one arranged on a respective piece-holding spindle 3.

The piece-holding spindles 3 are carried by respective trays 4. Each tray 4 carries a group of piece-holding spindles 3, in the example illustrated thirteen piece-holding spindles 3, respectively aligned along a rectilinear direction and rotatably engaged each with a base plate 5 of the tray 4.

Figure 2:
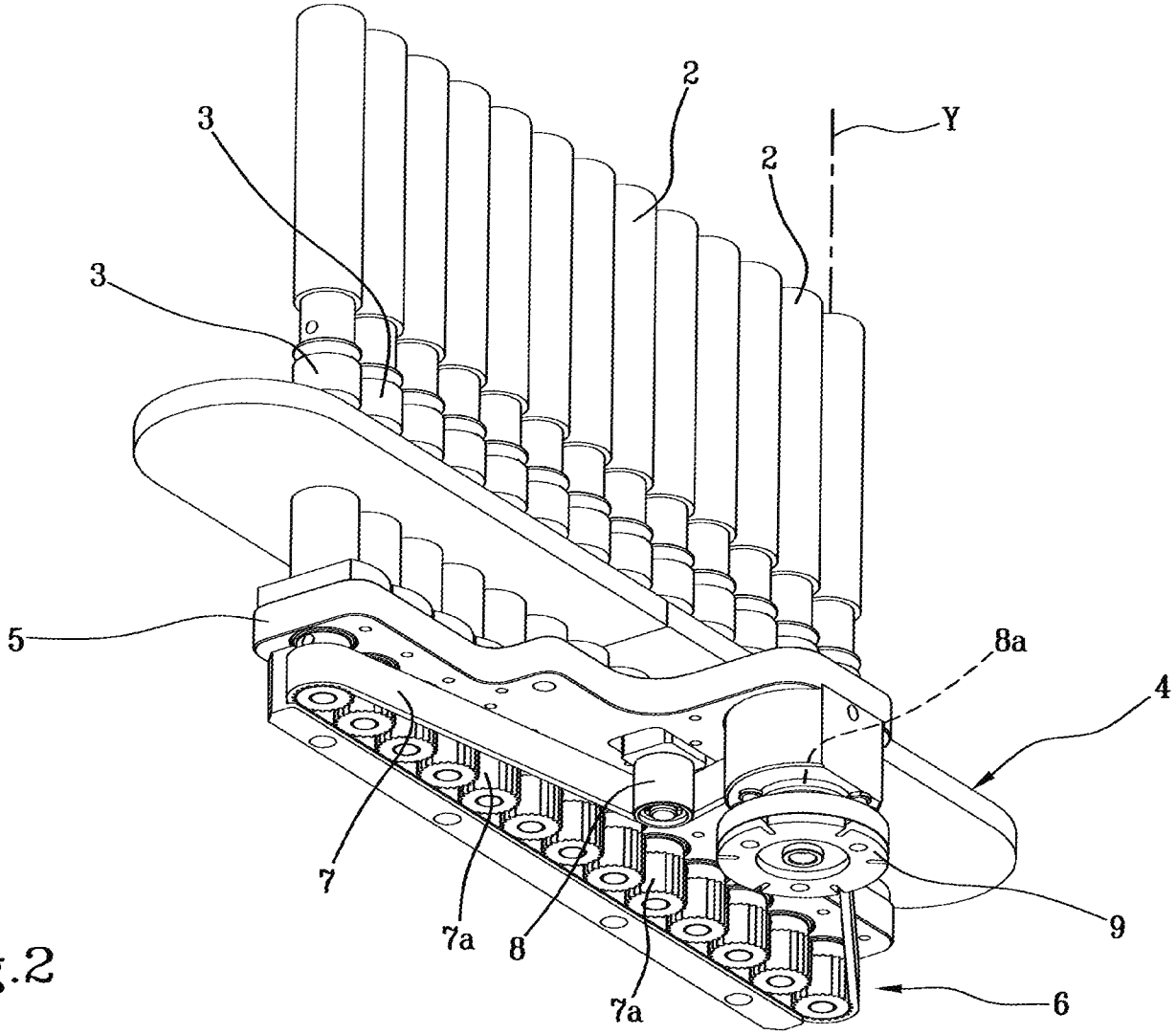
FIG. 2 represents an interrupted perspective view of a detail of the apparatus, showing rotational actuation devices associated with each of the trays.
Figure 3:
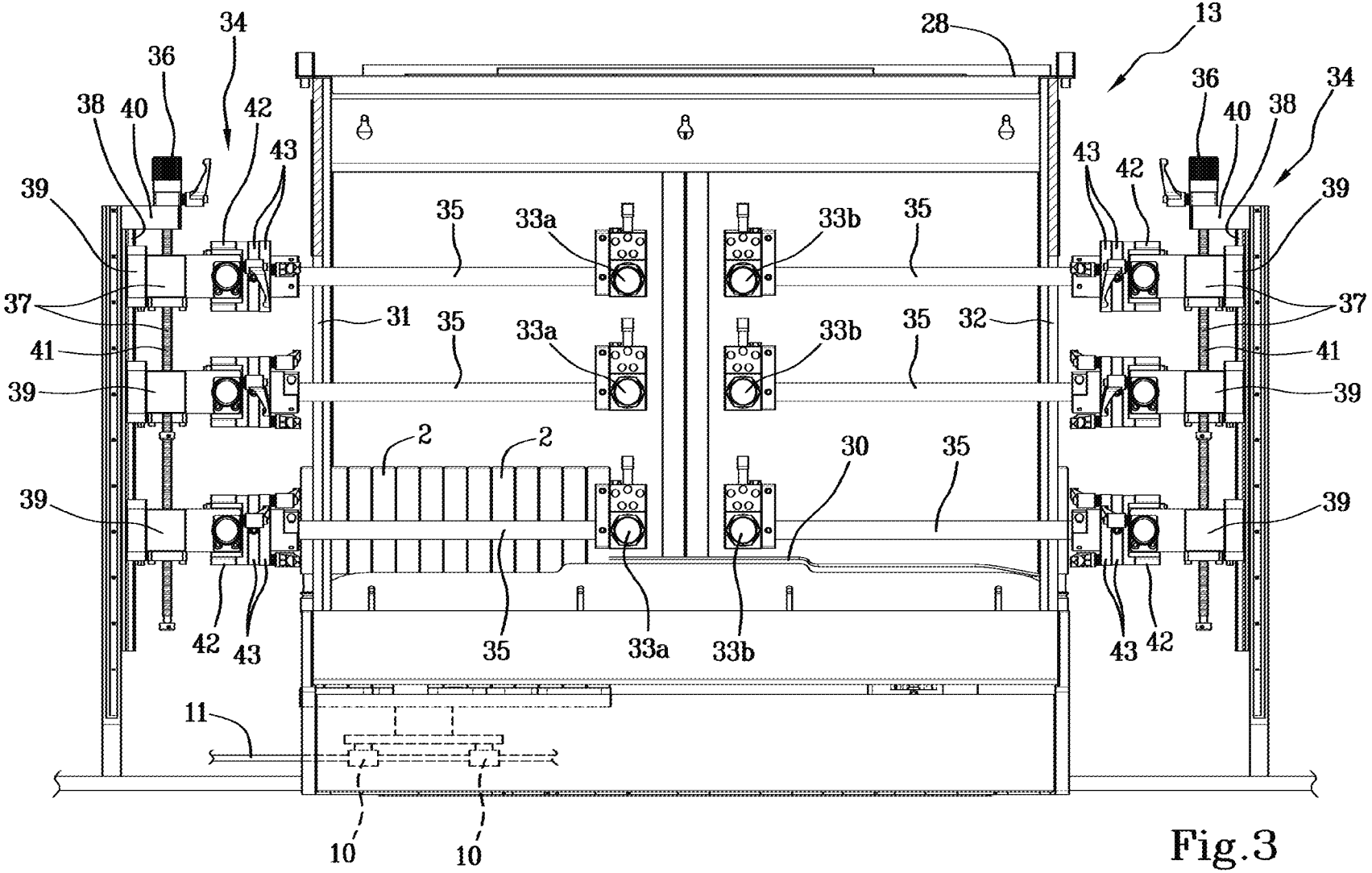
FIG. 3 represents an schematic elevation of a detail of the apparatus showing a painting station.
Figure 4:
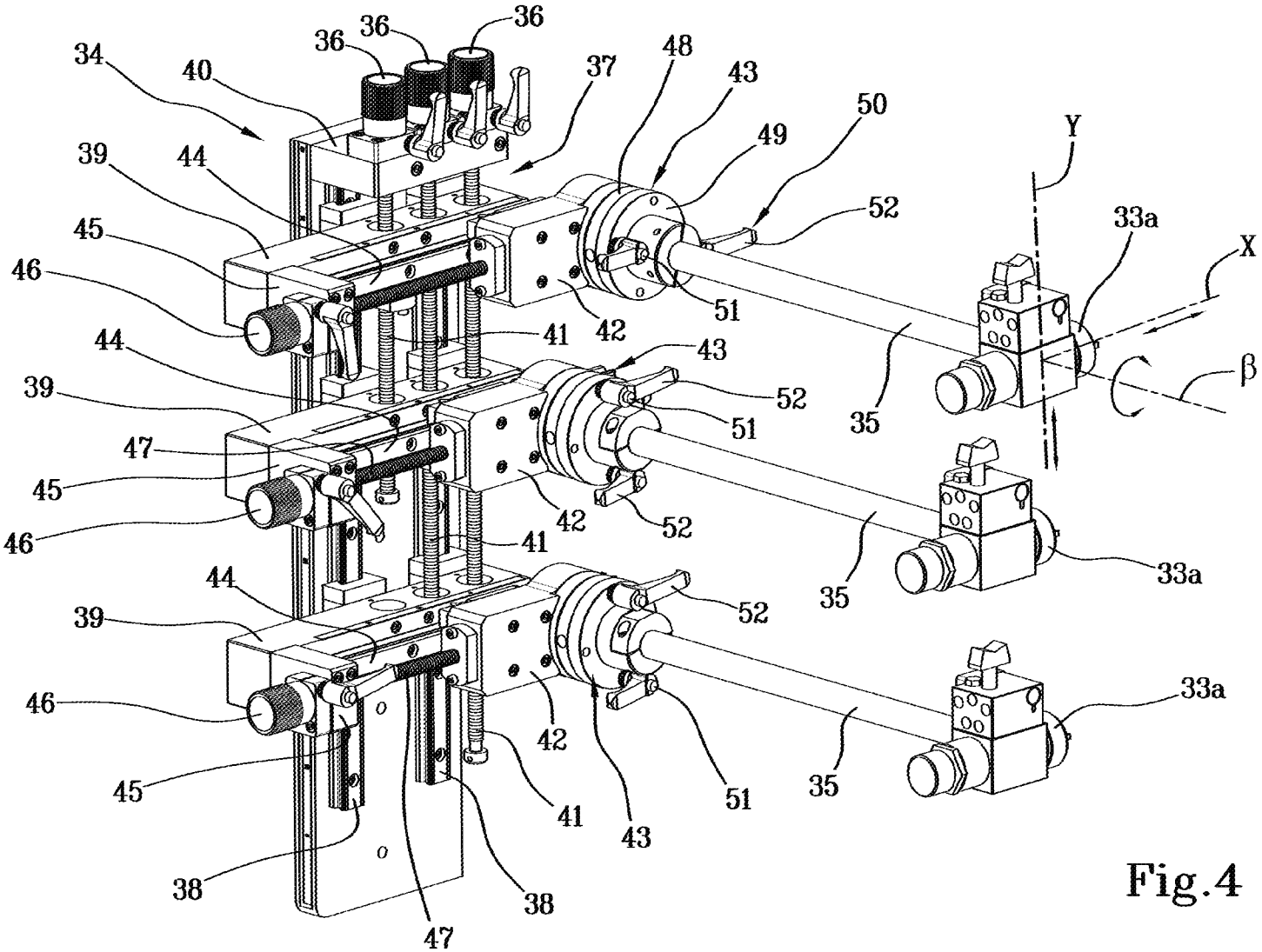
FIG. 4 represents a partial perspective view of a detail of the apparatus, showing adjustment devices associated with a first series of paint delivery nozzles.

Each tray 4 can be conveniently equipped with rotational actuation devices 6 for the piece-holding spindles 3. Preferably, as can be better seen in FIG. 2, such rotational actuation devices 6 comprise a toothed belt 7 or another transmission member extending around respective pulleys 8 carried by the base plate 5. One of the pulleys 8, non visible and indicatively identified by the reference 8*a*, is driving and coaxially integral with a drive member 9, comprising for example a draggable plate magnetically in rotation. The transmission member 7 operatively engages a plurality of toothed pinions 7*a*, each coaxially integral with one of the piece-holding spindles 3. By controlling the driving pulley 8*a* in rotation it is consequently possible to simultaneously actuate in rotation the piece-holding spindles 3 and the articles 2 carried by them, each around its own geometric axis Y.

The base plate 5 of each tray 4 carries, preferably on a lower side thereof, a plurality of rollers 10 by which each tray 4 is slidably engaged along a transport guide 11 extending, e.g., according to a closed line along a movement path P.

A plurality of work stations 12, 13, s distributed along the movement path P, each one arranged for the execution of a respective processing provided in a cycle of treatment of the articles 2.

The work stations 12, 13 identifiable in the illustrated example comprise a loading/unloading station 12 of the articles 2 on/from the individual trays 4, and a painting station 13 operating immediately downstream of the loading/unloading station 12. However, further work stations can be provided along the movement path P, e.g., an infrared drying station and/or a UV ray polymerization station, not visible in the drawings, through which the articles 2 carried by the trays 4 pass before reaching again the loading/unloading station again 12.

In the loading/unloading station 12, a manipulator 14 withdraws articles 2 previously treated from the respective tray 4 to replace them with new articles 2 to be subjected to the painting. The articles 2 to be treated can be withdrawn from a respective auxiliary tray 15 arriving along a first section of a supply line 16. The same auxiliary tray 15 also lends itself to receiving the painted articles 2 to remove them from the treatment apparatus 1, for example along a second section of the same supply line 16. The manipulator 14 can for example comprise a double gripping assembly which simultaneously withdraws articles 2 already treated or to be treated by the respective trays 4 and, after 180° rotation around a vertical axis, engages them again on the same trays 4 in reversed positions.

Along the movement path P a transport assembly 17 operates, which translates the trays 4 along the transport guide 11, through the painting station 13 and the other work stations provided along the movement path P.

For this purpose, the transport assembly 17 can for example comprise a toothed belt 18 or another flexible dragging member, extending around a plurality of toothed pulleys 19 by which it is made to advance along the movement path P, for example according to a continuous movement at constant speed, or according to a step-by-step movement. A plurality of translators 20 distributed along the toothed belt 18 each engaging a respective tray 4, to lead it along the movement path P.

At the painting station 13, as well as in one or more of the other work stations possibly provided along the movement path P, actuating members can also operate in rotation operatively engaged with the drive member to impose on each of the articles 2 a rotation around its own geometric axis, at least during their passage through the painting station itself. For example, these actuating members can comprise a dragging plate 21 carried by a carriage 22 movable parallel to the movement path P at the painting station 13. The dragging plate 21, operable by a respective rotation motor not visible in the drawings, is magnetically coupled with the drive member 9 carried by each tray 4, so as to control its rotation during the crossing of the painting station 13.

The painting station 13 comprises a painting booth 23 delimited among side walls, respectively the right 24, left 25, front 26, rear 27 and top 28 ones. On the opposite side of e top wall 28, the painting booth 23 has a bottom portion 29 crossed by a slot 30 extending along the movement path P. The slot 30 is wide enough to allow the passage of the piece-holding spindle 3, so that the articles 2 being processed are exposed inside the painting booth 23, while the underlying parts of the tray 4 are shielded from the bottom portion 29 and consequently protected against paint contamination.

Preferably, the painting booth 23 has at least one opening 31, 32 to allow the articles 2 being processed to enter and/or leave the painting booth 23. More particularly, in the illustrated embodiment an inlet opening 31 and an outlet opening 32 reciprocally aligned on two of the respectively opposite side walls, namely the left side wall 25 and the right side wall 24 are provided.

During processing, the transport assembly 17 leads the articles 2 inside the painting booth 23 through the inlet opening 31, and extract said articles 2 through the outlet opening 32, while the possible actuating members 21 control the rotation of the articles 2 carried by each tray 4 during the crossing of the painting booth 23.

Inside the painting booth 23 one or more delivery nozzles 33*a*, 33*b* are arranged, which are configured to deliver atomised paint against the articles 2 carried along the movement path P. In the illustrated example, six delivery nozzles 33*a*, 33*b* are provided, preferably divided into a first series 33*a* and a second series 33*b*.

On each of the delivery nozzles 33*a*, 33*b*, or on at least part of them, adjustment devices 34 operate, which are configured to modify their positioning with respect to the articles 2 being processed inside the painting booth 23.

In this regard, it is preferably provided that each delivery nozzle 33*a*, 33*b* is mounted at the end of a respective support rod 35, extending parallel to the movement path P, for example adjacent to the front wall 26 of the painting booth 23 and in a raised position with respect to trays 4.

Preferably, each of the support rods 35 preferably extends through one of the side walls 24, 25, 26, 27, 28. More particularly, the support rods 35 carrying the dispensing nozzles 33*a* belonging to the first series cross the left side wall 25, for example at the inlet opening 31, while the support rods 35 carrying the delivery nozzles 33*b* belonging to the second series extend through the right side wall 24, for example at the outlet opening 32.

The adjustment devices 34 also provide that each delivery nozzle 33*a*, 33*b* is combined with a respective first adjustment knob 36, positioned externally to the painting booth 23.

The transmission members 37 are operatively connected between the support rod 35 and the respective first adjustment knob 36, to modify the positioning of the delivery nozzle 33*a*, 33*b* upon a drive action on the knob itself.

The transmission members 37 are preferably positioned outside the painting booth 23 and engage one end of the support rod protruding externally from the painting booth itself. The transmission members 37 can comprise a first linear guide 38, preferably integral with respect to the painting booth 23 and extending along a first adjustment axis Z. In the illustrated preferential example, two first linear guides 38 are provided, one for each series of delivery nozzles 33*a*, 33*b*, each vertically extending next to one of the side walls, respectively the left 25 and right 24 ones.

The support rod 35 of each delivery nozzle 33*a*, 33*b* is connected to a respective first slider 39, slidably engaged along the respective first linear guide 38.

Each first linear guide 38 also carries a first block 40, which rotatably engages the first adjustment knob 36 of each delivery nozzles 33*a*, 33*b* belonging to the respective series. Each of the first adjustment knobs 36 is made integral with a first threaded bar 41 operatively engaged through the first block 40 and the respective first slider 39. Preferably, the first threaded bar 41 rotatably crosses the first block 40 and engages by screwing the first slider 39 of the respective delivery nozzle 33*a*, 33*b*.

Each of the first adjustment knobs 36 can be reached manually by an operator from outside the painting booth 23, and can be actuated in rotation to adjust the positioning of the respective delivery nozzle 33*a*, 33*b* along the first adjustment axis Z. In the illustrated example the first adjustment axis Z is orthogonal, and preferably vertical, with respect to the movement path P.

Preferably, each of the first sliders 39 is interconnected to the respective support rod 35 after interposition of at least one second slider 42 and possibly a rotation joint 43.

More particularly, the second slider 42 can be slidably engaged with a second linear guide 44 carried by the first slider 39 and extending along a second control axis X transverse, preferably orthogonal, with respect to the first adjustment axis Z. A second linear guide 44 is rigidly engaged to a second block 45, which rotatably engages a second adjustment knob 46, positioned externally to the painting booth 23.

A second threaded bar 47 integral with the second adjustment knob 46 is operatively engaged through the second slider 42 and the second block 45. Preferably, the second threaded bar 47 rotatably crosses the second block 45 and engages by screwing the second slider 42. Each of the second adjustment knobs 46 can be reached manually by an operator from outside the painting booth 23, and can be actuated in rotation to adjust the positioning of the respective delivery nozzle 33*a*, 33*b* along the second adjustment axis X. In the illustrated example, the second adjustment axis X is preferably horizontal and perpendicular to the movement path P.

Each rotation joint 43 is preferably positioned outside the painting booth 23 and can comprise a fixed portion 48, rigidly carried by the respective second slider 42, and a movable portion 49 rotatably engaged with the fixed portion 48 around a third adjustment axis β. Preferably, the third adjustment axis β is substantially coaxial to a longitudinal axis of the support rod 35. An angular rotation of the movable portion 49 and of the support rod 35 around the third adjustment axis β modifies the orientation of the paint jet produced by the respective delivery nozzle 33*a*, 33*b* in a vertical plane, according to an inclination more or less accentuated with respect to a horizontal direction.

Locking devices 50 are provided to rigidly lock the movable portion 49 with respect to the fixed portion 48. Such locking devices 50 can be selectively deactivatable to allow a rotation of the delivery nozzle 33*a*, 33*b* around the third adjustment axis β, preferably parallel to the movement path P.

For example, the locking devices 50 can comprise one or more threaded elements 51 configured to reciprocally clamp and lock the fixed portion 48 with the movable portion 49 of the rotation joint 43. Respective gripping knob 52 can be associated to the threaded elements 51 to facilitate the manual loosening and clamping thereof.

The present invention allows an easy adjustment of the positioning and/or orientation of the individual delivery nozzles 33*a*, 33*b*, without requiring the stopping of the processing along the painting apparatus 1. It is therefore simplified to obtain the optimal painting conditions according to the various parameters different from time to time, minimizing production waste. The optimization of the painting conditions also allows an appreciable reduction of paint waste, with consequent benefit in economic and environmental impact terms. An advantageous simplification and reduction in the frequency of maintenance operations, required to keep the internal surfaces of the painting booth 23 clean is also achieved. The positioning of the adjustment devices 34 on the outside of the painting booth 23 also allows an advantageous reduction of the dimensions thereof, for the benefit of the construction and maintenance costs and simplifying the realization of any accessory plants required for atmospheric conditioning inside the cabin itself.

The invention claimed is:

1. Apparatus for painting articles, comprising:

a painting booth delimited by side walls;

a transport assembly configured (i) to move a plurality of articles being processed along a movement path extending through the painting booth and (ii) to lead the articles being processed inside the painting booth, the plurality of articles respectively aligned along the movement path;

a dispensing nozzle operatively arranged inside the painting booth and configured to deliver atomised paint against the articles transported along the movement path;

a support rod carrying the dispensing nozzle and extending through one of the side walls of the painting booth; and a set of adjustment devices configured to operate on the dispensing nozzle to modify a positioning of the dispensing nozzle with respect to the articles being processed, wherein said set of adjustment devices comprises:

a first adjustment knob positioned outside the painting booth and configured to be manually accessible to an operator; and transmission members operatively connected with the support rod and with the first adjustment knob, and configured to modify the positioning of the dispensing nozzle upon a drive action on the first adjustment knob;

wherein said transmission members comprise:

a first linear guide extending along a first adjustment axis;

a first slider slidably engaged along the first linear guide and carrying said support rod;

a first block carried by the first linear guide and rotatably engaged by the first adjustment knob; and a first threaded bar integral with the first adjustment knob and operatively engaged through the first slider and the first block;

wherein the set of adjustment devices further comprises:

a second adjustment knob positioned outside the painting booth and configured to be manually accessible to an operator;

a second linear guide carried by the first slider and extending along a second adjustment axis transverse to the first adjustment axis;

a second slider slidably engaged along the second linear guide and carrying said support rod;

a second block carried by the second linear guide and rotatably engaged by the second adjustment knob; and a second threaded bar integral with the second adjustment knob and operatively engaged through the second slider and the second block.

2. The apparatus according to claim 1, wherein the transmission members are positioned outside the painting booth.

3. The apparatus according to claim 1, wherein the movement path extends through at least one opening arranged in at least one of the side walls of the painting booth, and wherein the support rod extends through the at least one of the side walls of the painting booth having said at least one opening.

4. The apparatus according to claim 1, wherein the second threaded bar is configured to rotatably cross the second block and engage by screwing into the second slider.

5. The apparatus according to claim 1, wherein said set of adjustment devices further comprises a rotation joint positioned outside the painting booth, and the rotation joint comprises:

a fixed portion rigidly carried by the second slider;

a movable portion rotatably engaged to the fixed portion about a third adjustment axis substantially coaxial with a longitudinal axis of the support rod; and locking devices of the movable portion with respect to the fixed portion, the locking devices being selectively deactivatable to allow rotation of the dispensing nozzle about the third adjustment axis.

6. The apparatus according to claim 1, comprising a plurality of dispensing nozzles, each provided with a respective set of adjustment devices.

7. The apparatus according to claim 6, wherein the first linear guide slidably engages two or more first sliders, each being part of the respective set of adjustment devices of a respective one of said dispensing nozzles.

8. The apparatus according to claim 1, comprising a first and a second series of dispensing nozzles, each carried by a respective support rod.

9. The apparatus according to claim 8, wherein the support rods carrying the dispensing nozzles belonging to the first and second series of dispensing nozzles extend through respective side walls of the painting booth.

10. The apparatus according to claim 1, wherein the transmission members engage one end of the support rod protruding externally from the painting booth.

11. The apparatus according to claim 1, wherein the support rod extends substantially parallel to the movement path.

* * * * *